US006942951B2

(12) United States Patent
Daimon et al.

(10) Patent No.: US 6,942,951 B2
(45) Date of Patent: Sep. 13, 2005

(54) IMAGE FORMING METHOD

(75) Inventors: Katsumi Daimon, Minamiashigara (JP); Takashi Imai, Minamiashigara (JP); Manabu Serizawa, Minamiashigara (JP); Hirokazu Hamano, Minamiashigara (JP); Norihito Fukushima, Minamiashigara (JP); Yuka Ishihara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/290,376

(22) Filed: Nov. 8, 2002

(65) Prior Publication Data

US 2003/0091924 A1 May 15, 2003

(30) Foreign Application Priority Data

Nov. 14, 2001 (JP) ..... 2001-348604

(51) Int. Cl.[7] ..... G03G 15/01

(52) U.S. Cl. ..... 430/45; 430/46; 430/47; 430/124

(58) Field of Search ..... 430/45, 46, 47, 430/124, 109.4, 108.4; 399/307

(56) References Cited

U.S. PATENT DOCUMENTS 3,093,039 A * 6/1963 Rheinhart ..... 399/307
3,967,962 A * 7/1976 O'Malley ..... 430/120
4,806,444 A 2/1989 Yanus et al.
5,689,786 A * 11/1997 Tokunaga et al. ..... 399/307
5,736,126 A * 4/1998 Van Engelen et al. ... 424/78.02
6,066,426 A * 5/2000 Mott et al. ..... 430/58.2
2002/0018952 A1 * 2/2002 Daimon et al. ..... 430/109.4

FOREIGN PATENT DOCUMENTS

JP A 2000-143786 5/2000
JP A 2001-117260 4/2001

* cited by examiner

*Primary Examiner*—Christopher Rodee
(74) *Attorney, Agent, or Firm*—Oliff & Berridge, PLC

(57) ABSTRACT

The present invention provides an image forming method for efficiently thermoelectrically transferring and fixing a toner image formed on an electrostatic latent image carrier without scattering of the toner. The image forming method comprises the steps of charging a surface of an electrostatic latent image carrier; exposing the charged surface of the electrostatic latent image carrier to a light beam using optical data corresponding to image data to form a latent image; developing the latent image formed on the surface of the electrostatic latent image carrier with a developer for electrophotography containing a toner for electrophotography to form a toner image; and thermoelectrically transferring the toner image formed on the surface of said electrostatic latent image carrier onto a surface of a recording medium and simultaneously fixing thereon. The toner for electrophotography is comprised of a crystalline polyester resin, the surface temperature of a fixing unit therein is higher by 10° C. or greater than the melting point of said crystalline polyester resin, and the glass transition temperature of the outermost surface layer of the electrostatic latent image carrier is higher by 10° C. or greater than a surface temperature of the fixing unit.

12 Claims, 1 Drawing Sheet

IMAGE FORMING METHOD

BACKGROUND OF THE INVENTION

1. Field of the Invention

The present invention relates to an image forming method making use of an electrophotographic apparatuses such as a copying machine, a printer, and a facsimile machine.

2. Description of the Related Art

As an example of a widely-used image forming method, there is an image forming method in which an electrostatic latent image is formed on an electrostatic latent image carrier, the latent image is developed with a dry toner into a toner image, and the toner image is electrostatically transferred onto and fixed on a recording medium. In this image forming method, however, there are problems that thickness heterogeneity may disadvantageously occur in an image, or that toner powder sometimes is scattered from the transfer section causing degradation of the resolution or dot reproducibility.

For the most part, these problems result from the transfer process of electrostatically transferring a toner image on the electrostatic latent image carrier onto a recording medium. Namely, in the electrostatic transfer system, a toner image formed on the electrostatic latent image carrier cannot homogeneously and efficiently be transferred onto a recording medium. In contrast, in the thermoelectric transfer system, a toner image formed on the electrostatic latent image carrier can efficiently be transferred by means of fusing without the toner powder being scattered. In this method, however, the energy consumption in the thermoelectric process or in the fixing process is disadvantageously high.

The present inventors disclosed in Japanese Patent Laid-Open Publication No. 2001-117260 an efficient method of forming a high quality image by thermoelectrically transferring a toner with the melting point in the range from 45° C. to 110° C. without causing scattering of the toner. Further, in Japanese Patent Laid-Open Publication No. 2001-117260, the inventors disclosed a thermoelectric image forming method making use of an intermediate transfer belt, but simplification of the image forming process is effective for cost and size reduction of a printer, and, when viewed from this standpoint, it is desirable that the number of transfer steps after development of an electrostatic latent image with a toner be minimized.

It is a first object of the present invention to provide an image forming method capable of efficiently transferring a toner image formed on an electrostatic latent image carrier onto a recording medium and fixing it thereon by means of fusing without scattering of the toner powder.

It is a second object of the present invention to provide an image forming method in which relatively less energy is consumed in the thermoelectric transfer and fixing steps.

It is a third object of the present invention to simplify the process of forming a toner image on a recording medium.

SUMMARY OF THE INVENTION

The objects described above can be achieved with the following means. More specifically, the present invention provides an image forming method comprising the steps of charging a surface of an electrostatic latent image carrier; exposing the charged surface of the electrostatic latent image carrier to form a latent image with optical data corresponding to the image data; developing the latent image formed on the surface of the electrostatic latent image carrier with a developer for electrophotography including a toner for electrophotography to form a toner image; and thermoelectronically transferring and fixing the toner image formed on the surface of the electrostatic latent image carrier on a surface of a recording medium, wherein said toner for electrophotography contains a crystalline polyester resin as a main component; a temperature on a surface of a fixing unit is higher by 10° C. or greater than the melting point of the crystalline polyester resin; the glass transition temperature of the utmost surface layer of said electrostatic latent image carrier is higher by 10° C. or greater than the temperature on the surface of the fixing unit.

DETAILED DESCRIPTION OF THE INVENTION

Figure 1:
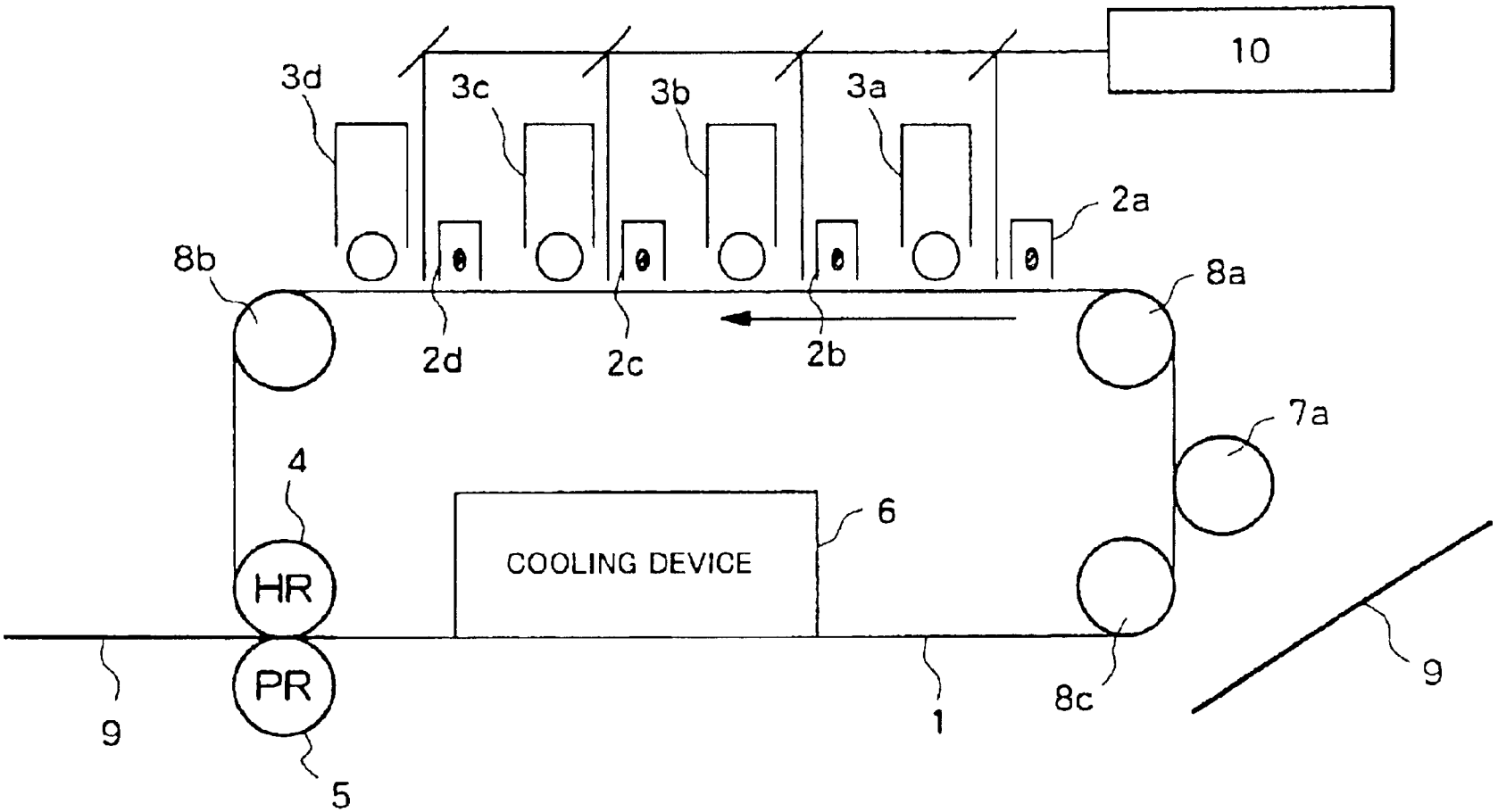
FIG. 1 is a general schematic view showing one example of the image forming apparatus, which can advantageously be used in the image forming method according to the present invention.

The image forming method according to the present invention comprises the steps of charging a surface of an electrostatic latent image carrier (referred to hereinafter as "a charging step"), exposing the charged surface of the electrostatic latent image carrier to form a latent image with optical data corresponding to the image data ("an exposing step"), developing the latent image formed on the surface of the electrostatic latent image carrier with a developer for electrophotography including a toner for electrophotography to form a toner image ("a developing step"), and thermoelectronically transferring and fixing the toner image formed on the surface of the electrostatic latent image carrier on a surface of a recording medium.

(Toner for Electrophotography)

The toner for electrophotography contains a crystalline polyester resin as its main component, and is used for fixing with a fixing unit with the surface temperature of not less than 10° C. equivalent to the melting point of the crystalline polyester resin. In the present invention, the surface temperature of the fixing unit is in the range from 70 to 180° C., more preferably in the range from 70 to 150° C., and most preferably in the range from 80 to 100° C. More specifically, the melting point of the toner for electrophotography is in the range from 45 to 120° C., preferably in the range from 50 to 100° C., and more preferably in the range from 60 to 80° C. When the temperature exceeds the melting point, the toner for electrophotography loses its viscosity, so that, when the toner for electrophotography is stored at a temperature higher than the melting point, blocking occurs. Because of the property, the toner for electrophotography should have a melting point higher than the temperature to which the toner for electrophotography is exposed during storage or in use, preferably a melting point of 45° C. or more. However, when the melting point is higher than 120° C., fixing cannot be performed under a low temperature. The melting point can be obtained as the fusion peak temperature for input compensation differential scanning calorie measurement as defined in JIS K-7121.

Although a crystalline polyester resin is used in the present invention, any crystalline resin other than crystalline polyester resin may be used as long as the resin satisfies the requirements described above. It should be noted that, when the medium used for fixing is paper, crystalline polyester resin is preferable because of its adhesive properties.

(Binding Resin)

The crystalline polyester resin employed in the present embodiment contains a polyester resin comprising an acid-derived component and an alcohol-derived component, along with other components selected according to use requirements.

The polyester resin is synthesized from an acid (dicarboxylic acid) and an alcohol (diol) component As used herein, an "acid-derived component" refers to an ingredient which was previously a component of the acid before synthesis of the polyester resin, "alcohol-derived component" refers to an ingredient which was a component of the alcohol before synthesis of the polyester resin, and "crystalline polyester resin " indicates not a resin having a step-like endothermal change, but a clear endothermic peak as defined in relation to the differential scanning calorie (DSC) measurement. Additionally, any other copolymer in which one or more components is bonded to a main chain of the crystalline polyester and the content of other components is not more than 50 weight %, is also referred to as a crystalline polyester.

Acid-derived Component

The acid to be used for obtaining the acid-derive component as defined above is preferably a fatty dicarboxylic acid, and more preferably a straight chain type of carboxylic acid. Suitable acids for this purpose include, but are not limited to, oxalic acid, malonic acid, succinic acid, gultaric acid, adipic acid, pimelic acid, suberic acid, azelic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, and lower alkyl esters or acid anhydrates thereof.

The acid-derived component should preferably contain, in addition to that derived from the fatty acid dicarboxylic acid, a component derived from a dicarboxylic acid having a double bond, a dicarboxylic acid having a sulfonic acid group and other appropriate dicarboxylic acids.

The component derived from the dicarboxylic acid having a double bond includes also those from a lower alkyl ester or an anhydrate of the dicarboxylic acid having a double bond. The component derived from a dicarboxylic acid having a sulfonic acid group includes also those from a lower alkyl ester or an anhydrate of the dicarboxylic acid having a sulfonic acid group.

A dicarboxylic acid having a double bond can advantageously be used for preventing the hot offset in the fixing process because it double bond can be used to ensure that all of the resin is bridged. The dicarboxylic acid as described above includes, but is not limited to, for example, fumaric acid, maleic acid, 3-hexene dioic acid, and 3-ontene dioic acid. Further lower alkyl esters and anhydrates of these acids can be used for the same purpose. Of these compounds, fumaric acid and maleic acid are especially preferable from the viewpoint of cost.

The dicarboxylic acid having a sulfonic acid group is advantageous because it is possible to efficiently disperse a color material such as pigment with the dicarboxylic acid. Further, if a sulfonic acid group is available, all of the resin can be emulsified or suspended to prepare particles thereof without using a surfactant. Dicarboxylic acids having a sulfonic acid group include, but not limited to, for example, sodium 2-sulfotelephtarate, sodium 5-isophthalate and sodium sulfosuccinate. In addition, lower alkyl esters and acid anhydrates of the acids may be used for the same purpose. Of these, sodium 5-sulfoisophtalate is preferable from the viewpoint of cost.

Content of the component derived from an acid other than the fatty dicarboxylic acid (a component from a dicarboxylic acid having a double bond and/or that having a sulfonic acid group) in the acid-derived component should preferably be in the range from 1 to 20 composition mole %, and more preferably in the range from 2 to 10 composition mole %.

When the content is less than 1 composition mole %, pigment can not be dispersed well, or an emulsion particle size may becomes larger, which makes it difficult to adjust the toner particle size by means of aggregation. On the other hand, when the content is over 20 composition mole %, the crystallinity of the polyester resin is degraded such that the melting point is lowered and preservative property of an image developed with the toner is poor, or the emulsion particle size is so small so that the particles are dissolved in water with the result that generation of latex cannot be assured.

It should be noted that the "composition mole %" as used herein indicates a percentage assuming a component of each component in the polyester resin (an acid-derived component, or an alcohol-derived component) as 1 unit (mole).

Alcohol-derived Component

A fatty diol is preferable as the alcohol-derived component, and includes, but is not limited to, for example, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-dodecane diol, 1,12-undecane diol, 1,13-tridecane diol, 1,14-tridecane diol, 1,18-octadecane diol, 1,20-eicosane diol.

In the alcohol-derived component, content of the component derived from the fatty diol should be more than 80 composition mole %, and components may be included according to requirements. In the alcohol-derived component, a content of the component derived from the fatty diol should preferably be more than 90 composition mole %.

When the content is less than 80 composition mole %, the crystallinity of the polyester resin is degraded and the melting point lowered, such that the capability of preventing toner blocking, preservative property of an image developed with the toner, and adaptability to fixing under a low temperature are all degraded.

Other components contained therein include those derived from a diol having a double bond or from a diol having a sulfonic acid group.

The diol having a double bond includes 2-butene-1,4-diol, 3-butene-1,6-diol and 4-butene-1,8-diol.

The diol having a sulfonic acid group includes sodium 1,4-dihydroxy-2-benzenesulfonate, sodium 1,3-dihydroxymethyl-5-benzenesulfonate, and 2-sulfo-1,4-butadiol sodium salt.

When an alcohol-derived component other than that derived from anyone of these straight type of diol is added, namely when a component or components from a diol having a double bond and/or a diol having a sulfonic acid group is added, a content of the component derived from the alcohol(s) should preferably be in the range from 1 to 20 composition mole %, and more preferably in the range from 2 to 10 composition mole %.

When the content is less than 1 composition mole %, dispersibility of pigment may be poor and the emulsion particle size may become larger, which makes it difficult to adjust the toner particle size by means of aggregation. On the other hand, when the content is over 20 composition %, crystallinity of the polyester resin is degraded with the melting point lowering, preservative property of an image developed with the toner may be degraded, and the emulsion particle size may be too small or dissolved in water, which may prevent generation of latex.

It should be noted that a differential scanning calorimeter (DSC) was used for measurement of the melting point of the polyester resin, and that a top value among the endothermic points obtained in measurement at the programming rate of 10° C. per minute in the range from the room temperature to 150° C. was used for measurement.

Colorant

Colorants to be used in this invention are not limited by the invention, and may be freely selected from among known colorants to fit intended use. A single pigment may be used, a plurality of pigments belonging to a same category may be mixed together, or a plurality of pigments belonging to different categories may be mixed. The colorants include, but are not limited to, for example, pigments such as chrome yellow, hanza yellow, benzidine yellow, sullen yellow, quinolline yellow, permanent orange GTR, pyrazolone orange, Balkan orange, Watch-Young red, permanent red, brilliant carmine 3B, brilliant carmine 6B, Dupont oil red, pyrazolone red, lithol red, rhodamine B lake, lake red C, rose Bengal, aniline blue, ultramarine blue, Carco-oil blue, methylene blue chloride, phtalocyannine blue, phtalocyannine green, malachite green oxalate; and various types of dye stuffs such as those based on acridine, xanthene, azo, benzoquinone, azine, anthraquinone, dioxadine, thiazin, azomethine, indigo, thioindigo, phtalocyannine, aniline black, polymethine, triphenylmethane, diphenyl methane, and thiazole. A black pigment or dye such as carbon black may be mixed with these colorants to a degree where the transparency is not spoiled. A disperse dye or an oil-soluble dye may also be used for this purpose.

A content of the colorant in the toner for electrophotography should preferably be in the range from 1 to 30 weight portions assuming a weight of the resin as 100, but the value should preferably be as large as possible within that range to that extent that the smoothness of a surface of a fixed image developed with the toner is not impaired. When the content of the colorant is large, the thickness of an image can be made thinner when developing images with the same thickness, which is advantageous for prevention of offsetting.

It should be noted that toners having various colors such as yellow, magenta, cyan, and black can be obtained by appropriately selecting colorants as described above.

Other Components

Other components to be used in conjunction with the present invention are not specifically or uniquely restricted, and any one may be selected from the known types of additives such as inorganic fine particles, organic fine particles, electrification control agents, and release agents may be employed.

Inorganic fine particles are generally used for improving the fluidity of a toner. Examples of inorganic fine particles include, for example, those of silica, alumina, titanium oxide, barium titanate, magnesium titanate, calcium titanate, strontium titanate, zinc oxide, silica sand, clay, mica, wallostonite, diatomite, cerium chloride, colcothar, chromium oxide, cerium oxide, antimony trioxide, magnesium oxide, zirconium oxide, silicon carbide, and silicon nitride. Of these materials, silica fine particles are preferable, and silica fine particles having been subjected to the processing for converting the particles to hydrophobic ones are especially preferable.

The average primary particle size of the inorganic fine particles should preferably be in the range from 1 to 1000 nm, and a quantity of the added component should preferably be in the range from 0.01 to 20 weight portions against 100 weight portions of the toner.

The organic fine particles are generally used for improving the adaptability of a toner cleaning or transfer. The organic fine particles include, for example, those of polystyrene, polymethyl methacrylate, and vinylidene polyfluoride.

An electrification control agent is generally used for improving the electrostatic property. Acceptable electrification control agents include, for example, metal salicylates, metal-containing compounds, quaternary ammonium salts.

The release agent is generally used for improving release property. Acceptable release agents include low molecular weight polyolefins such as polyethylene, polyopropylene, and polybutene; silicones having softing point when heated; fatty acid amides such as amide oleate, amide erucite, amide ricinoleate, and amide stearate; botanical waxes such as carnauba wax, Rice wax, Candelila wax, Japan wax and jojoba oil wax; animal waxes such as bees wax; and mineral or oil-based waxes such as montan wax, ozokerite, ceresin, paraffin wax, microcrystalline wax, and Fischer-Tropsch wax. Any of these release agents may be used singly or in combination.

An addition rate of these release agents is preferably in the range from 0.5 to 50 weight %, more preferably in the range from 1 to 30 weight %, and still further preferably in the range from 5 to 15 weight %. When the percentage is less than 0.5 weight %, no effect is achieved by adding the release agent, and when the percentage is 50 weight % or more, the electric property may easily be affected by external conditions or the toner may easily break down within a developing unit, which in turn causes delivery of the release agent onto a carrier with resulting effects such as discharge of static electricity. In addition, with a color toner with the release agent content of 50 weight % or more, the toner is insufficiently exuded over a surface of an image in fixing, and the release agent is apt to remain on the image, which disadvantageously degrades the transparency.

Other Requirements

A surface of the toner particles for electrophotography according to the present invention may be covered with a surface layer. A surface layer which will not greatly affect the mechanical characteristics and viscosity or elasticity of the toner itself when it is melted is preferable. For example, when a barely melted surface layer or a layer having a high melting point covers the toner particles, the toner can not sufficiently be fixed under a low temperature, even if a crystalline resin is contained in the toner. Therefore, the thickness of the surface layer should preferably be relatively small, more specifically a thickness in the range from 0.001 to 0.5 $\mu$m is preferable.

To form a thin surface layer within the range noted above, the method of chemically processing a surface of the particles containing, in addition to a binding or adhesive resin and a colorant, inorganic particles and other materials added according to the necessity is advantageously employed.

Components for constituting the surface layer may include a silane-based coupling agent, isocyanates, and vinyl-based monomers. Further it is preferable that each of the components has a polar group. In such a case, the adhesiveness between the toner and a transferred medium such as paper is increased by the chemical bond to each components.

All of the polar groups containing a polarizable functional group may be used. Such polar groups include, for example, a carboxyl group, a carbonyl group, an epoxy group, an ether group, a hydroxyl group, an amino group, an imino group, a cyano group, an amide group, an imide group, an ester group, and a sulfo group.

Example suitable methods for chemically processing a surface of toner particles include a method of processing the particle surface by oxidizing the surface with a strong oxidant such as peroxides or ozone, or by oxidizing it with plasma, and a method of processing the surface by combining a polymeric monomer having a polar group to the surface by means of graft polymerization. With the chemical processing as described above, the polar group strongly bond to a molecular chain in the crystalline resin by covalent bonding.

In the present invention, an electrically chargeable substance may additionally be deposited chemically or physically on a surface of the toner particle. Further fine particles of metal, metal oxides, metal salts, ceramics, resins, carbon black or the like may be added for improving such properties as electric chargeability, conductivity, fluidity, and release property of the toner particles, if necessary.

The average volume particle size of the toner for electrophotography according to the present invention may preferably be in the range from 1 to 20 $\mu$m, more preferably in the range from 2 to 8 $\mu$m, and the average number particle size thereof should preferably be in the range from 1 to 20 $\mu$m, and more preferably in the range from 2 to 8 $\mu$m.

The average volume particle size and average number particle size can be obtained by, for example, measuring the particles using the Coulter counter Model TA-II (produced by Coulter Co., Ltd.) with the aperture diameter set to 50 $\mu$m. The measurement should be performed after the toner is dispersed in an electrolyte aqueous solution (isoton aqueous solution) and the mixture solution is subjected to ultrasonic processing for 30 seconds or more.

(Developer for Electrophotography)

The developer for electrophotography may comprise one component having developer for electrophotography which includes a magnetic or non-magnetic component including at least the toner for electrophotography according to the present invention, or one comprising two components having developer for electrophtography which includes at least the toner for electrophotography according to the present invention and a carrier.

When the one component having developer for electrophotography is one magnetic component having a developer for electrophotography, magnetic power may be added thereto, or a portion or all of the colorant for black may be replaced with magnetic powder. Any known magnetic powder may be used in this invention, and for example, metals such as iron, cobalt, nickel, and alloys thereof, metal oxides such as $Fe_3O_4$, $\gamma$-$Fe_2O_3$, cobalt-added iron oxides, and magnetite, and ferrites such as Mn Zn ferrite and Ni Zn ferrite may be employed as materials for the magnetic powder. A content of these added magnetic materials is generally in the range from 30 to 70 weight %.

The carrier to be used in the two components having developer for electrophotography is not specifically restricted, and any known carrier, such as a resin-coated carrier, may advantageously be used in the present invention. The resin-coated carrier comprises a core material and a resin coating the core material. The core material may be used a magnetic powder, which includes, for example, iron, ferrites, and nickel. Resins which can be used for coating the core material include, for example, a fluororesin, a vinyl-based resin, and a silicone-based resin.

(Electrostatic Latent Image Carrier)

Any known organic photosensitive material may be used as the electrostatic latent image carrier according to the present invention. The carrier may have a form like a drum, a sheet, or a belt, but a belt-formed carrier is preferable when required members are provided within the image forming apparatus having a compact arrangement and a temperature of the electrostatic latent image carrier is controlled with a heating/cooling apparatus. Although the electrostatic latent image carrier used in the present invention basically comprises a conductive substrate, an under layer, an electric charge generating layer, and an electric charge transfer layer, it is not always required that the electric charge generating layer and electric charge transfer layer are separated from each other. A surface coat layer may further be provided, when preferable, to improve ease of release or separation.

The glass transition temperature of the outermost surface layer of the electrostatic latent image carrier according to the present invention is required to be more than 10° C. equivalent to a surface temperature of the fixing unit, if the outermost surface layer is either the surface coat layer or the electric charge transfer layer. When the electrostatic latent image carrier is heated, the surface energy of the surface layer should be lowered as much as possible so that the toner can smoothly be transferred from the surface layer to a recording medium. To lower the surface energy, fluorine-containing fine particles may be present in the surface layer at the percentage from 1 to 10%, and more preferably from 2 to 5%.

When the electric charge transfer layer is the outermost surface layer of the electrostatic latent image carrier, the glass transition temperature of the electric charge transfer layer is more than 10° C. which is equivalent to the surface temperature of the fixing unit. When the toner is heated and melted on the electrostatic latent image carrier and then is transferred and fixed on a recording medium, if properties of a surface of the electrostatic latent image carrier changes or the adhesiveness between the surface of the electrostatic latent image carrier and the toner increases, a desired image can not be obtained. In the present invention, the electrostatic latent image carrier is heated to a temperature equivalent to the surface temperature of a fixing unit when the toner is thermally transferred and fixed. The surface temperature of the fixing unit is, as described above, in the range from 70 to 180° C., and more preferably in the range from 70 to 150° C., and still further preferably in the range from 80 to 100° C. In an example wherein a nip is formed with an electrostatic recording medium and a heating roller and a toner is fixed by the nip, if a toner with the melting point of 70° C. is melted and fixed with the fixing nip having width of 6 mm at the process speed of about 100 mm/sec, the fixing temperature is 80° C., so that the surface temperature of the heating roller is set to about 80° C. When the toner is contacted to the heating roller and the electrostatic latent image carrier, the heat is conducted through the recording medium to the toner, so that the toner itself is heated to a temperature of 70° C. or more and can be fixed to the recording medium, and in this step also the outermost surface of the electrostatic latent image carrier itself is heated to 70° C. or more. If the glass transition temperature of the surface layer is less than 70° C., the toner will adhere to a surface of the electric charge transfer layer during the steps of thermal transfer and fixing, as the result, hot offset causes. The recording medium will also adhere to a surface side of the electric charge transfer layer in a section where an image is not recoded when the glass transition temperature of the outermost surface of the electrostatic latent image carrier is in the range from 70° C. to 80° C. In such a case the recording medium cannot be separated therefrom, and an image therefore cannot be formed on the recording medium such as paper.

On the other hand, when the electrostatic latent image carrier itself is used as a heating roller, there is no substantial difference between a section where the paper recording medium is passed over and a section where the paper is not passed over, but, unless the glass transition temperature is at least 80° C., the melted toner will adhere to the electrostatic latent image carrier. Therefore the glass transition temperature should be more than 90° C., and more preferably be more than 100° C., to insure superior durability. The heat resistance of the electrostatic latent image carrier as a whole should be as high as possible.

To insure reliability, the glass transition temperature of an outermost surface of the electrostatic latent image carrier may be more than 10° C., which is equivalent to a surface temperature of the fixing unit, preferably more than 20° C., and still further preferably more than 30° C., which is equivalent to a surface temperature of the fixing unit.

Typically the electric charge transfer layer is formed by making any known material for an electric charge transfer layer phase-soluble to a transparent resin such as polycarbonate. In such a case, however, the material for an electric charge transfer layer may become a plasticizer, which in turn lowers the glass transition temperature of the polymer itself. For example, although the glass transition temperature of the polycarbonate (Z) resin is about 160° C., if the material for an electric charge transfer layer is made phase-soluble by about 40 weight % of the polycarbonate (Z) resin to form an electric charge transfer layer, the glass transition temperature drops to the range from 70 to 90° C. In such case, the toner adhering to the electric charge transfer layer makes it impossible to form an image on a recording medium such as paper. Therefore, a resin with a high glass transition temperature of 160° C. or more is preferable as a polymer to be used for forming the electric charge transfer layer, and the polymer is more preferably a material made by phase-dissolving electric charge transfer to a resin with the glass transition temperature of 180° C. Resins suitable for this purpose include, but are not limited to, polyphenylene oxide, aromatic polyesters, and polysulfon. When a resin having a high glass transition temperature as described above is used, even if the material for forming the electric charge transfer layer is made phase-soluble by about 40 weight %, the glass transition temperature of the layer itself can be made higher than the melting point of the toner.

It is further advantageous to employ an electric charge transferable polymer with the material for electric charge transfer incorporated into a main chain of the polymer itself. When an electric charge transfer material such as triphenyl amine or benzidine is chemically bonded to a main chain of the polymer, the glass transition temperature of the electric charge transfer material has only to be more than 10° C. which is equivalent to a surface temperature of the fixing unit. The materials as described above include, but are not limited to, the electric charge transferable polycarbonate with arylamine incorporated in the main chain of polycarbonate (disclosed in U.S. Pat. No. 4,806,444), and the electric charge transferable polyester with arylamine incorporated in the main chain of polyester (disclosed in Japanese Patent Laid Open Publication No. 2000-143786). The binding resins other than polyesters which can be used for this purpose include, for example, polycarbonate resin, polyester resin, methacrylic resin, acrylic resin, polystyrene resin, polyvinyl acetate resin, styrene-butadiene copolymer, silicon resin, silicon-alkyd resin, phenol-formaldehyde resin, styrene-alkyd resin, poly-N-vinyl carbazole, and polysilane, and the electric charge transferable polyester is the most preferable because of its easiness in production and the electric charge transfer performance. In addition to the aryl amine-based electric charge transferable material, a hydrazone-based or stilbene-based electric charge transferable material may be used as the materials to be incorporated in a main chain of the polymer. The thickness of this electric charge transfer layer may be in the range from 5 to 50 μm, and more preferably in the range from 10 to 40 μm.

On the other hand, it is also advantageous to provide a surface coat layer with the glass transition temperature higher than 10° C. equivalent to the surface temperature of the fixing unit on the ordinary electric charge transfer layer. This surface coat layer may be formed, for example, by impregnating a conductive material in a resin with the glass transition temperature of 100° C. or more. Materials suitable for the conductive material above include, but are not limited to, metallocene compounds, aromatic amino compounds, antimony oxide, indium oxide, and tin oxide. Any known resin such as polyamide resin, polyphenylene oxide, aromatic polyester, and polysulfon may be used for this purpose. A three-dimensional networked layer formed by chemically bonding an electric charge transfer material to a silicon compound may also be used.

The electric resistance of the surface layer as a protection layer may preferably be set within the range from $10^9$ to $10^{14}$ Ωcm.

When a surface coat layer is provided and the electric charge transfer layer is not the outermost surface layer, the electric charge transfer layer can be prepared and used by making any known electric charge transfer material phase-soluble to a known binding resin. Hydrazone-based, triarylamine-based and stilbene-based electric charge transfer materials may be used singly or in combination as the electric charge transfer material. The binding resins available for this purpose include, but are not limited to, known resins such as polycarbonate resin, polyester resin, methacrylic resin, acrylic resin, polystyrene resin, polyvinyl acetate resin, styrene-butadiene copolymer, silicon resin, silicon-alkyd resin, phenol-formaldehyde resin, styrene-alkyd resin, poly-N-vinyl carbazole, and polysilane. Of these binding resins, the polycarbonate resin is the most preferable, because the phase solubility is excellent and a homogenous film can be obtained with the resin. The electric charge transferable polyester vs binding resin blending ratio (on the weight base) is preferably in the range from 10:0 to 8:10. Further when mixed with other electric charge transfer material, [the electric charge transferable polyester+binding resin] vs. electric charge transfer material blending ratio may preferably be in the range from 10:0 to 10:8.

The thickness of the electric charge transfer layer may preferably be in the range from 5 to 50 μm, and more preferably in the range from 10 to 40 μm. As the method of applying the resin for providing the electric charge transfer layer, any of known methods such as the blade coating method, Mayer bar coating method, spray coating method, dip coating method, bead coating method, air knife coating method, and curtain coating method may be employed.

As the conductive substrate, for example, metals such as aluminum, nickel, chromium, and stainless steel, plastic films with a thin film comprising aluminum, titanium, nickel, chromium, stainless steel, gold, vanadium, tin oxide, indium oxide, and ITO (indium titanium oxide) formed thereon, paper with a conductivity additional agent applied thereon or impregnated therein can be enlisted. As the belt supporting body, use of a plastic film with a conductive thin film provided thereon is preferable. As the plastic film, such materials as polyester, polycarbonate, polyamide, polyurethane, vinyl fluoride, and polyimide may be used. A surface of the conductive substrate may be subjected to various types of processing as long as the image quality is not negatively affected. For example, the surface may be subjected to processing such as oxidation, chemical processing, coloring, or roughing with sand. An under layer may also be provided between the conductive substrate and the electric charge generating layer. When the photosensitive layer based on a lamination structure is electrified, the under layer prevents electric charge from being injected from the conductive substrate into the photosensitive layer and also functions as a adhesive layer for adhering and holding the photosensitive layer to the conductive layer in the integrated state. The under layer also prevents reflection of light on the conductive layer in some cases.

The binding agents which may used for this under layer include such known materials as polyethylene resin, polypropyrene resin, acrylic resin, methacrylic resin, polyamide resin, vinyl chloride resin, vinyl acetate resin, phenol resin, polycarbonate resin, polyurethane resin, polyimide resin, vinylidene chloride resin, polyvinyl acetal resin, vinyl chloride-vinyl acetate copolymer, polyvinyl alcohol resin, water-soluble polyester resin, cellulose nitrate, casein, gelatin, polygurtamic acid, starch, starch acetate, amino starch, polyacrylic acid, polyacrylamide, zirconium chelate compounds, titanium chelate compounds, titanium alkoxide compounds, organic titanium compounds, and silane coupling agent. The thickness of the under layer should preferably be in the range from 0.01 to 10 $\mu$m, and more preferably in the range from 0.05 to 2 $\mu$m. Any of the conventional coating methods such as the blade coating method, Mayer bar coating method, spray coating method, dip coating method, bead coating method, air knife coating method, and curtain coating method may be used for providing the under layer.

It is preferable to use a crystal of phthalocyanine as an electric charge generating material for the electric charge generating layer, but any of known electric charge generating materials such as bisazo pigments, phthalocyanine pigments, squalilium pigments, perylene pigments, and dibromoanthanthrone may be used.

The binding resin for providing the electric charge-generating layer can be selected from many insulating resins. Further, the binding resin can also be selected from organic photoconductive polyesters such as poly-N-vinyl carbazole, polyvinyl anthracene, polyvinyl pyrene, and polysilane. The preferable resins are insulating resins such as polyvinyl butyral resin, polyacrylate resin (such as a condensation polymer between bisphenol A and a phtalic acid), polycarbonate resin, polyester resin, phenoxy resin, vinyl chloride-vinyl acetate copolymer, polyamide resin, polyacrylamide resin, polyvinyl pyridine resin, cellulose resin, urethane resin, epoxy resin, casein, polyvinyl alcohol resin, and polyvinyl pyrroridone resin. These resins may be used singly or in combination.

The blending ratio of the electric charge generating material to the binding resin should preferably be in the range from 10:1 to 1:10. To disperse these materials, any conventional method such as the ball mill dispersion method, atritor dispersion method, and sandmill dispersion method may be employed. Further in this dispersion step, the particle size should preferably be adjusted to less than 0.5 $\mu$m, preferably to less than 0.3 $\mu$m, and more preferably to less than 0.15 $\mu$m. As a solvent to be used in this dispersion step, any of the conventional organic solvents such as methanol, ethanol, n-propanol, n-butanol, benzyl alcohol, methyl cellosolve, acetone, methyl ethyl ketone, cyclohexane, methyl acetate, n-butyl acettate, dioxane, tetrahydrofuran, methylene chloride, chloroform, chlorobenzene, and toluene may be used singly or in combination. The thickness of the electric charge generating layer should preferably be in the range from 0.01 to 10 $\mu$m, and preferably in the range from 0.05 to 5 $\mu$m. As the coating method for providing the electric charge generating layer, any conventional method such as the blade coating method, Mayer bar coating method, spray coating method, dip coating method, bead coating method, air knife coating method, and curtain coating method may be employed.

(Recording Medium)

The recording medium (recording material) to be used in the present invention may be, for example, a sheet of ordinary paper or an OHP sheet used in a copying machine or a printer both based on the electrophotography system. When it is necessary to further improve the smoothness of a surface of a recorded image after fixing, a surface of the recording medium should be made as smooth as possible, and coated paper prepared by coating a surface of ordinary paper with a resin or the like, art paper for printing, or the like may be used for this purpose.

[Image Forming Method]

The image forming method according to the present invention comprising the steps of charging, exposing, developing, and thermoelectrically transferring and fixing. If necessary, the image forming method may further comprise the steps of removing electric charge for removing an electrostatic latent image still remaining on a surface of an electrostatic latent image carrier, and cleaning for removing toner left and paper or other dust deposited during the thermal transfer step on a surface of the electrostatic latent image carrier. The image forming method is described in detail below.

(Charging Step)

In the charging step, any conventional method such as a non-contact charging method using the corotron, or a contact charging method using a charged film or a charged brush may be employed. In the exposing step, any conventional method may be used, and an electrostatic latent image may be formed by means of the electrophotography or electrostatically recording method on a latent image carrier such as a photosensitive layer or a dielectric material layer.

(Exposing Step)

Any conventional method may be employed in the exposing step, and, for example, an latent image is formed by the electrophotography or electrostatic recording method in which a latent image is formed on a surface of an electrostatic latent image carrier by using optical data corresponding to the image data and performing exposure according to gradation of image thickness according to the area modulation method.

(Developing Method)

In the developing step, a developer layer formed on a developer carrier and containing a toner therein is carried to a developing nip, and the developer layer and the electrostatic latent image carrier are positioned in a developing section in the state where they contact each other or maintain with a gap between both, and the electrostatic latent image is developed with the toner by loading a bias to the section between the developer carrier and the electrostatic latent image carrier. The developer for electrophotography used in this developing step is a developer for electrophotography comprising two components, which electrostatically charges the toner with a carrier, or a developer for electrophotography comprising one component, which electrostatically charges a thin film of toner formed on the developer carrier with such a tool as an elastic blade.

(Thermoelectrically Transferring and Fixing Step)

In the thermoelectrically transferring and fixing step, the operations for thermoelectrically transferring and fixing a toner image are performed simultaneously by heating the toner image. More specifically, the electrostatic latent image carrier is heated with a heat roller or the like to melt the toner, and the toner is simultaneously placed in close contact with a recording medium to thermoelectrically transfer and fix the toner image on the recording medium. Any means for heating the electrostatic latent image carrier may be used as long as the toner can be heated to the melting point of the toner or higher, and heating can be performed with a heat roller combined with, for example a halogen lamp or an electromagnetic induction heater. Additionally, an electrostatic latent image carrier may be formed by providing an electrostatic latent image carrier layer on an exothermal resistive element. To thermoelectrically transfer and fix a toner image on a recording medium with a heat roller, it is preferable that the heat roller can closely contact and press the heated electrostatic latent image carrier to the recording medium. After the toner image is transferred and fixed on the recording medium, the electrostatic latent image carrier is separated from the recording medium. The separation may be performed immediately after the toner image is thermoelectrically transferred and fixed, but it is possible to provide a device for cooling the image section before the electrostatic latent image carrier is separated from the recording medium. Provision of the cooling device is preferable because the efficiency in the step of thermoelectrically transferring a toner image and smoothness of an image developed with the toner are improved.

(Electric Charge Removing Step)

In the electric charge removing step, an electrostatic latent image remaining on the electrostatic latent image carrier is removed using a light source which is different from that used for forming an image, to initialize (remove an electric charge on) the electrostatic latent image carrier having been subjected to the developing step, or to stabilize the image forming performance.

(Cleaning Step)

In the cleaning step, the toner not transferred in the transfer step and still remaining on the electrostatic latent image carrier is cleaned with a cleaner, but this invention can also be applied to an apparatus having no cleaner. The cleaning may be performed using any commonly applied device such as a blade, a brush, or a roller.

The image forming method according to the present invention makes it possible to design a compact machine in which a toner image is thermoelectrically transferred and fixed simultaneously, by using the toner for electrophotography and the electrostatic latent image carrier, and provides a simple image forming process not requiring the electrostatic transfer step like that in the conventional technology and providing a clear image with little scattering of toner.

The image forming process according to the present invention is described in more detail below.

FIG. 1 is a schematic diagram showing one example of an image forming apparatus which can advantageously be used in the image forming method according to the present invention, and the image forming method according to the present invention is described below in further detail with reference to FIG. 1. This figure shows an example of forming a full color image, and, when a monochrome image is to be formed, each of the charging, exposing, and developing steps need be performed only once for the color black.

In FIG. 1, a belt-shaped electrostatic latent image carrier 1 is supported by rollers 8*a*, 8*b*, 8*c*, and rotates in the direction indicated by the arrowhead. The electrostatic latent image carrier 1 is homogeneously charged by a charger 2*a*, and is then exposed to a light beam irradiated via a half mirror from a light beam scanning device turned ON or OFF by a light bean pulse width modulator (not shown) in response to a thickness signal, such that an electrostatic latent image is thus formed thereon. The electrostatic latent image is developed by a developing unit 3*a* storing a colorant for yellow and a yellow toner image, which is a digital image showing thickness degrees of various sections of an image by means of area modulation, is formed on the electrostatic latent image carrier 1. Then, the yellow toner latent image is exposed to a light beam from the light beam scanning device 10 in the same manner as described above to form a latent image, which is developed with a magenta toner stored in a developing unit 3*b*. Cyan and black latent images are developed successively in the same manner, until the final image is formed.

The final image is thermoelectrically transferred onto a recording medium 9, heated and melted thereon by a heating roller 4, and simultaneously pressed by the pressurizing roller 5 to the recording medium 9 for fixing the toner image thereon. It should be noted that positions of the heating roller 4 and pressurizing roller 5 may be exchanged with each other. The electrostatic latent image carrier 1 is separated from the recording medium 9 at a position of a roller 8*c*, and a color toner fixed image is formed on the recording medium 9. If the image is cooled by a belt cooler 6 in this step, the thermoelectrically transferred and fixed image can be separated in the fully solidified state, which not only reduces image offset but also provides images with excellent surface smoothness.

A surface temperature of the heating roller 4 is measured with a surface thermometer provided on the heating roller 4. The surface thermometer may be, for example, a temperature probe, or an infrared sensor.

After the recording medium 9 is separated, a surface of the electrostatic latent image carrier 1 is cleaned with a cleaning roller 7*a* with the initial state restored. It is also advantageous to remove the remaining electric charge with an electric charge remover.

EXAMPLES

Example of Material Preparation 1

Preparation of a Toner for the Electrophotography and a Developer

Synthesis of Crystalline Polyester Resin (1)

124 weight portions of ethylene glycol, 22.2 weight portions of sodium dimethyl 5-sulfoisofurate, 213 weight portions of dimethyl sebacate, and 0.3 weight portions of dibutyl tin oxide as a catalyst were put in a heated and dried three neck flask, and then the air in the flask was depressurized and replaced with nitrogen gas to realize the inert atmosphere therein, and the mixture was mechanically agitated for 5 hours at 180° C. The mixture was gradually heated to 220° C. in the depressurized state over 2 hours with agitation until the mixture became gummy, and then the reaction was stopped with the mixture cooled by air to obtain 220 weight portions of crystalline polyester resin (1).

The molecular weight of the polyester resin (converted to that of polystyrene) as measured by gel permeation chromatography (GPC), and the result shows that the weight-average molecular weight ($M_w$) of the resultant crystalline polyester resin (1) is 11000, and the number-average molecular weight ($M_n$) is 4700.

The melting point (Tm) of the crystalline polyester resin (1) was measured with a differential scanning calorimeter (DSC) in the same manner as described above, and the result showed a clear peak, and the temperature corresponding to the peak top was 69° C.

The ratio of a content of copolymer component (5-isofutarate component) vs that of sebacate component measured from NMR spectrum of the resin was 7.5:92.5.

<Preparation of Electrophotography Toner (1) for Cyan>

Preparation of a Resin Dispersion Liquid (1)

150 weight portions of the crystalline polyester resin (1) was put in 850 weight portions of distilled water, and the mixture was agitated with a homogenizer (manufacture by IKA Japan K. K., Ultra Tarax) at 80° C. to obtain a resin particle dispersion liquid (1). Then 250 weight portions of phthalocyanine pigment (manufactured by Dainichiseika Color & Chemicals Mfg. Co., Ltd.: PV FAST BLUE), 20 weight portions of anionic surfactant (manufactured by Dai-ichikogyo Seiyaku Co., Ltd.: NEOGEN RK), and 730 weight portions of ion-exchanged water were added and dissolved in the mixture, and the resultant mixture was well dispersed with a homogenizer (manufactured by IKA K. K.: Ultra Tarax) to obtain a colorant dispersion liquid (1) with a colorant (phthalocyanine pigment dispersed therein).

Preparation of Aggregated Particles 2400 weight portions of the resin particle dispersion liquid (1), 100 weight portions of the colorant dispersion liquid, 63 weight portions of a release agent particle dispersion liquid, 10 weight portions of lauroyl peroxide, 5 weight portions of aluminum sulfate (manufactured by Waco Pure Chemical Industries, Ltd.), and 100 weight portions of ion-exchanged water were put in a round bottom stainless flask with pH (hydrogen ion exponent)adjusted to 2.0, and the mixture was dispersed with a homogenizer (manufactured by IKA Corporation: Ultra Tarax T50), and was agitated and heated to 65° C. in an oil bath for heating. The mixture was maintained at a temperature of 65° C. for 3 hours, after which it was observed with an optical microscope. It was observed that aggregated particles each with the average particle size of about 6.0 μm had been formed. The mixture was further agitated for an additional one hour with the temperature maintained at 65° C., and then was observed with an optical microscope. It was then observed that aggregated particles each with the average particle size of about 7.8 μm had been formed.

The pH of this aggregated particle liquid was 2.4. 0.5 weight % sodium carbonate aqueous solution was slowly added to adjust the pH to 5.0, and the mixture was heated to 75° C. agitating, and was mixture was maintained for 3 hours in the state.

The reaction products were then filtered and the filtrate was fully cleaned with ion-exchanged water and dried with a vacuum drier to obtain the toner for electrophotography (1). The melting point of the toner obtained as described above was 65° C.

The volume-average particle size of the toner for electrophotography (1) was measured with the Coulter counter Model TA-II (with the aperture diameter of 50 μm, manufactured by Coulter Inc.), and the average volume particle size was 7.9 μm.

Preparation of the Electrophotography Toner (1) for Yellow

The same processing sequence as that for preparation of the electrophotography toner (1) for cyan was followed to obtain the electrophotography toner for yellow with the exception that the yellow-azo pigment was used in place of the phthalocyanine pigment.

Preparation of the Electrophotography Toner (1) for Magenta

The same processing sequence as that for preparation of the electrophotography toner (1) for cyan was followed to obtain the electrophotography toner for magenta, with the exception that the quinacridone pigment was used in place of the phthalocyanine pigment.

Preparation of the Electrophotography Toner (1) for Black

The same processing sequence as that for preparation of the electrophotography toner (1) for cyan was followed to obtain the electrophotography toner for black with the exception that carbon black was used in place of the phthalocyanine pigment.

Preparation of a Developer

The hydrophobic silica R972 (manufactured by Japan Aerosol K.K.) in amount 1% weight of that of each the toner was added in each of the toners for four colors obtained as described above, and the mixture was further mixed with a carrier to prepare a developer comprising two components.

Example of Material Preparation 2

Preparation of an Electrostatic Latent Image Carrier

Example of Synthesis of the Electric Charge Transferable Polymer

Synthesis of Monomer 1

Synthesis of 3,3'-dimethyl-N,N'-bis(3,4-dimethylphenyl)-N,N'-bis(4-(2-(methoxycarbonyl)ethyl))phenyl)-[1,1'-biphenyl]-4,4'-diamine (the partial structure shown in I-19, and both of the termini are methyl ester respectively) (Japanese Patent Laid-Open Publication No. 2000-143786)

45 g of N-(3,4-dimethylphenyl)-N-(4-(2-(methoxycarbonyl)ethyl)phenyl) amine, 30 g of 4,4'-diiode-3,3'-dimethyl biphenyl, 27 g of potassium carbonate, 5 g of copper sulfate pentahydrate, and 20 ml of n-tridecane were put in a 1000 ml flask, and the mixture was reacted for five hours at 230° C. in a nitrogen gas flow. After completion of the reaction, the mixture was cooled to room temperature, and was dissolved in 200 ml of toluene with the impurities filtered off, and the filtered liquid was refined with toluene by means of silica gel chromatography and was recrystallized with a mixed solvent of ethyl acetate and ethanol to obtain 38 g of 3,3'-dimethyl-N,N'-bis(3,4-dimethylphenyl)-N,N'-bis(4-(2-(methoxycarbonyl)ethyl))phenyl)-[1,1'-biphenil]-4,4' diamine as light yellow powder (with the melting point in the range from 161.5 to 163° C.)

Synthesis of the Electric Charge Transferable Polymer 1

90.6 g of 3,3'-dimethyl-N,N'-bis(3,4-dimethylphenyl)-N,N'-bis(4-(2-(methoxycarbonyl)ethyl))phenyl)-[1,1'biphenyl]-4,4'-diamine synthesized in the example of monomer synthesis 1, 100 ml of ethylene glycol, and 0.1 g of tetrabutoxy titanium were put in a 100 ml flask, and the mixture was heated to 180° C. and maintained at that temperature for 5 hours in a nitrogen gas. When generation of methanol and ethylene glycol ended, the mixture was further heated up to 200° C. with the atmosphere depressurized to 1 mmHg, and the reaction was further continued for two hours. When this reaction was complete, the mixture was cooled to the room temperature and dissolved in 300 ml of ethylene chloride with the impurities filtered away. 50 ml of 1N hydrochloric acid was added and the mixture was severely agitated for 30 minutes and then was sufficiently washed and dripped into 2000 ml of isopropanol with agitation to have the polymer precipitated. The obtained polymer was filtered, and was fully washed with isopropanol and dried to obtain 84.6 g of polymer. The molecular weight was measured by GPC to find that the Mw was $4.4\times10^4$ (as converted to styrene). Tg of the obtained polymer was 112° C.

Synthesis of the Electric Charge Transferable Polymer 2

Synthesis of Monomer 2

Synthesis of N,N'-bis(3,4-dimethylphenyl)-N,N'-bis(4-(2-(methoxycarbonyl)ethyl)phenyl)-[1,1':4,1"-tarphenyl]-4,4"- diamine (the partial structure is shown in I-31, and both of the termini are methyl ester respectively)

(Japanese Patent Laid-Open Publication No. 2000-143786)

5.0 g of N-(3.4-dimethylphenyl)-N-(4-(2-(methoxycarbonyl)ethyl)phenyl) amine, 3.8 g of 4,4"-diiode-[1,1':4',1"-tarphenyl], 2.9 g of potassium carbonate, 1.0 g of cupper sulfate pentahydrate, and 10 ml of n-tridecane were put in a 200 ml flask, and the mixture was heated and reacted for 5 hours at 230° C. in a nitrogen gas flow. After the reaction ended, the mixture was cooled to room temperature and then dissolved in 20 ml of toluene with the impurities filtered away, the filtered liquid was refined with toluene by means of silica gel chromatography and was recrystallized from acetone to obtain 3.7 g of N,N'-bis(3,4-dimethylphenyl)-N,N'-bis(4-(2(methoxycarbonyl)ethyl)phenyl)-[1,1':4,1"-tarphenyl]-4,4"-diamine as light yellow powder (with the melting point in the range from 146 to 147° C).

Synthesis of Electric Charge Transferable Polymer 2

90 g of the N,N'-bis(3,4-dimethylphenyl)-N,N'-bis(4-(2-(methoxycarbonyl)ethyl)phenyl)-[1,1':4,1"-tarphenyl]-4,4"-diamine synthesized in the example of monomer synthesis 2 above, 100 ml of ethylene glycol, and 0.1 g of tetrabutoxy titanium were put in a 1000 ml flask, and the mixture was heated to and maintained at 180° C. for 5 hours in a nitrogen gas flow. When generation of methanol and ethylene glycol ended, the mixture was further heated to 200° C. with the atmosphere depressurized to 1 mmHg and was maintained at that temperature for 2 hours. After the reaction was complete, the mixture was cooled to room temperature and was dissolved in 300 ml of methylene chloride with the impurities removed by filtering. 50 ml of 1N hydrochloric acid was added to the solution and the resulting mixture was severely agitated for 30 minutes, fully washed with water, and dripped into 200 ml of isopropanol with agitation to have the polymer precipitated. The obtained polymer was filtered and fully washed with isopropanol, and was then dried to obtain 85 g of polymer. The molecular weight was measured by GPC to find that the Mw was $2.8\times10^4$ (as converted to styrene). Tg of the obtained polymer was 200° C.

Electric Charge Transferable Polymer 3

Synthesis of Monomer 3

Synthesis of 3,3'-dimethyl-N,N'-bisphenyl-N,N'-bis(4-(2-(methoxycarbonyl)ethyl)phenyl)-[1,1'-biphenyl]-4,4'-diamine (The partial structure is shown in I-15, and both of the termini are methyl ester respectively)

45 g of N-phenyl-N-(4-(2-(methoxycarbonyl)ethyl)phenyl)amine, 30 g of 4,4'-diiode-3,3'-dimethyl biphenyl, 27 g of potassium carbonate, 5 g of copper sulfate pentahydrate, and 20 ml of tridecane were put in a 1000 ml flask, and the mixture was heated to and maintained at 230° C. for 5 hours in a nitrogen gas flow. After the reaction was complete, the mixture was cooled to the room temperature and dissolved in 200 ml of toluene with the impurities removed by filtering, and the filtered liquid was refined with toluene by means of silica gel chromatography and recrystallized with a mixture solution of ethyl acetate and ethanol to obtain 38 g of 3,3'-dimethyl-N,N'-bisphenyl-N,N'-bis(4-(2-(methoxycarbonyl)ethyl)phenyl)-[1,1'-biphenyl]-4,4'-diamine as light yellow powder.

Synthesis of Electric Charge Transferable Polymer 3

90 g of the 3,3'-dimethyl-N,N'-bisphenyl-N,N'-bis(4-(2-(methoxycarbonyl)ethyl)phenyl)-[1,1'-biphenyl]-4,4'-diamine synthesized above, 100 ml of ethylene glycol, and 0.1 g of tetrabutoxy titanium were put in a 1000 ml flask, and the mixture was heated to and maintained at 180° C. for 5 hours in a nitrogen gas flow. When generation of methanol and ethylene glycol ended, the mixture was further heated to 200° C. with the atmosphere depressurized to 1 mmHg, and was maintained at that temperature for additional 2 hours. After the reaction was complete, the mixture was cooled to room temperature and dissolved in 300 ml of methylene chloride with the impurities removed by filtering. 50 ml of 1N hydrochloric acid was added to the solution, and the resultant mixture was strongly agitated for 30 minutes, thoroughly washed with water, and then dripped into 2000 ml of isopropanol being agitated to have a polymer precipitated. The obtained polymer was filtered, fully washed with isopropanol, and dried to obtain 82.6 g of the polymer. The molecular weight was measured by GPC to find that the Mw was $3.3\times10^4$ (as converted to styrene). The Tg of the obtained polymer was 98° C.

[Preparation of Electrostatic Latent Image Carrier (1)]

An aluminum film was provided on a belt-formed polyimide substrate, and a solution comprising 20 weight portions of zirconium compound (Product name: Organotics ZC 540, manufactured by Matsumoto Seiyaku Co., Ltd.), 2.5 weight portions of silane compound (Product name: A1100, manufactured by Japan Unicur Co., Ltd.), polyvinyl butyral resin (Product name; S-LEC BM-S, manufactured by Sekisui Chemical Co., Ltd.); 45 weight portions of butanol was coated over the aluminum film; and the coating layer was heated and dried for 10 minutes at 150° C. to provide an under layer with the film thickness of 1.0 $\mu$m.

1 weight portion of chlorogallium having strong refraction peaks at the Bragg angles ($2\theta\pm0.2°$) of 7.4°, 16.6°, 25.5° and 28.3° was mixed with 1 portion of polyvinyl butyral (Product name: S-LEC BM-S, manufactured by Sekisui Chemical Co., Ltd.) and 100 weight portions of n-butyl acetate to prepare a dispersion liquid, and the obtained coating liquid was applied on the under layere, which was heated to and maintained at 100° C. for 10 minutes to obtain an electric charge generating layer with the film thickness of 0.15 $\mu$m.

Then a coating liquid prepared by dissolving 3 weight portions of the electric charge transferable polymer (1) in 20 weight portions of chlorobenzene was applied on the electric charge generating layer, which was heated to and maintained at 110° C. for 40 minutes to form an electric charge transfer layer with the film thickness of 20 $\mu$m. The glass transition temperature of the outermost surface layer was 112° C.

[Preparation of Electrostatic Latent Image Carrier (2)]

The electrostatic latent image carrier (2) was prepared by following the same processing sequence as that for preparing the electrostatic latent image carrier (1) above with the exception that that the electric charge transferable polymer (2) was used in place of the electric charge transferable polymer (1). The glass transition temperature of the outermost surface layer was 200° C.

[Preparation of Electrostatic Latent Image Carrier (3)]

The electrostatic latent image carrier (3) was prepared by following the same processing sequence as that used to prepare the electrostatic latent image carrier (1) above with the exception that the electric charge transferable polymer (3) was used in place of the electric charge transferable polymer (1). The glass transition temperature of the outermost surface layer was 98° C.

[Preparation of Electrostatic Latent Image Carrier (4)]

The electrostatic latent image carrier (4) was prepared by following the same processing sequence as that used to prepare the electrostatic latent image carrier (1) above with the exception that the electric charge transfer layer was prepared by using 2 weight portions of N,N-bis(3-methyphenyl)-1,1'-biphenyl-4,4'-diamine and 3 weight portions of polycarbonate (Z) resin (with the viscosity average molecular weight of 39,000) in place of 3 weight portions of the electric charge transferable polymer (1).

Example 1

The prepared electrostatic latent image carrier (1) and the developers (1) for each color were set in the image forming apparatus as shown in FIG. 1. Temperature of a nip section between the heating roller and the electrostatic latent image carrier was set to 100° C. to form an image. Scattering of toner as observed in the case of electrostatic image transfer could not be found on the fixed image, and the thermoelectric transfer was performed without remaining any residual toner on the electrostatic latent image carrier. Temperature of the nip section was measured with a temperature probe provided on the heating roller. Temperature of the nip section was measured in the same manner in the following examples.

Example 2

The prepared electrostatic latent image carrier (2) and the developers (1) for each color were set in the image forming apparatus as shown in FIG. 1. Temperature of a nip section between the heating roller and the electrostatic latent image carrier was set to 100° C. to form an image. Scattering of toner as observed in the case of electrostatic image transfer could not be found on the fixed image, and the thermoelectric transfer was performed without remaining any residual toner on the electrostatic latent image carrier.

Comparative Example 1

The electrostatic latent image carrier (2) prepared as described above and the developer for A color 935 manufactured by Fuji Xerox Co., Ltd. (non-crystalline polyester) were set in the image forming apparatus as shown in FIG. 1.

Temperature of a nip section between the heating roller and the electrostatic latent image carrier was set to 100° C. to form an image, but the toner could not be fixed to the recording paper and was separated off therefrom. When temperature of the nip section between the heating roller and the electrostatic latent image carrier was set to 145° C., the image was fixed. No scattering of toner was observed on the obtained fixed image, and it was confirmed that the thermoelectric transfer was formed without leaving any residual toner on the electrostatic latent image carrier. It was also confirmed, however, that a large quantity of energy was required for fixing.

Comparative Example 2

The electrostatic latent image carrier (3) prepared as described above and developers (1) for each color were set in the image forming apparatus as shown in FIG. 1. Temperature of a nip section between the heating roller and the electrostatic latent image carrier was set to 100° C. to form an image. The recording paper was wrapped around the electrostatic latent image carrier together with the toner and could not be separated therefrom, and an image could not be obtained.

Comparative Example 3

The electrostatic latent image carrier (4) prepared as described above and the developers (1) were set in the image forming apparatus as shown in FIG. 1. Temperature of a nip section between the heating roller and the electrostatic latent image carrier was set to 100° C. to form an image, but the recording paper was wrapped around the electrostatic latent image carrier together with the toner and could not be separated therefrom, so that an image could not be obtained.

It was also confirmed that an image could not be formed unless the glass transition temperature of the outermost surface layer of the electrostatic latent image carrier was more than 10° C. equivalent to the fixing temperature or at least more than the melting point of the toner.

As described above, the present invention can provide an image forming method which makes possible simplification of the process for forming a toner image on a recording medium, and also to thermoelectrically transfer and fix a toner image formed on the electrostatic latent image carrier efficiently without scattering of the toner and while a relatively low energy consumption.

What is claimed is:

1. An image forming method comprising the steps of:

forming a full color toner image comprising a yellow toner image, a magenta toner image, a cyan toner image and a black toner image where each of the yellow toner image, the magenta toner image, the cyan toner image and the black toner image are individually prepared by the steps of:

charging a surface of an electrostatic latent image carrier;

exposing the charged surface of the electrostatic latent image carrier to a light beam using optical data corresponding to image data to form a latent image;

developing the latent image formed on the surface of the electrostatic latent image carrier with a developer for electrophotography including a yellow toner, a magenta toner, a cyan toner or a black toner for electrophotography to form yellow, magenta, cyan or black toner image; and thermoelectrically transferring by heating the full color toner image formed on the surface of the electrostatic latent image carrier onto a surface of a recording medium and simultaneously fixing the full color toner image thereon by means of a fixing unit, wherein each of said yellow toner, magenta toner, cyan toner and black toner comprises a crystalline polyester resin, wherein a surface temperature of the fixing unit therein is higher by 10° C. or greater than the melting point of the crystalline polyester resins, and wherein the glass transition temperature of the outermost surface layer of the electrostatic latent image carrier is higher by 10° C. or greater than a surface temperature of the fixing unit.

2. The image forming method according to claim 1, wherein a surface temperature of the fixing unit is in the range from 70° C. to 180° C.

3. The image forming method according to claim 1, wherein the melting point of the yellow toner, magenta toner, cyan toner and black toner for electrophotography is in the range from 45° C. to 120° C.

4. The image forming method according to claim 1, wherein the crystalline polyester resin comprises an acid-derived component and an alcohol-derived component.

5. The image forming method according to claim 4, wherein the acid-derived component contains a component derived from fatty dicarboxylic acid.

6. The image forming method according to claim 5, wherein the acid-derived component further contains at least either one of a component derived from dicarboxylic acid having a double bond and a component derived from dicarboxylic having a sulfonic acid group.

7. The image forming method according to claim 4, wherein the alcohol-derived component contains a component derived from fatty diol.

8. The image forming method according to claim 7, wherein the alcohol-derived component contains at least either one of a component derived from diol having a double bond and a component derived from diol containing a sulfonic acid group.

9. The image forming method according to claim 1, the electrostatic latent image carrier has a form chosen from drum, sheet, and belt forms.

10. The image forming method according to claim 1, wherein the outermost surface layer of the electrostatic latent image carrier is a surface coat layer or an electric charge transfer layer.

11. The image forming method according to claim 10, wherein the outermost surface layer of the electrostatic latent image carrier is an electric charge transfer layer, and the electric charge transfer layer comprises a resin with the glass transition temperature of more than 160° C. and an electric charge transfer material, or comprises an electric charge transferable polymer with an electric charge material incorporated in its main chain.

12. The image forming method according to claim 10, wherein the outermost surface layer of said electrostatic latent image carrier is a surface coat layer, and the surface coat layer comprises a resin with the glass transition temperature of more than 100° C. and a conductive material.

* * * * *